US009114612B2

(12) United States Patent
Kato et al.

(10) Patent No.: US 9,114,612 B2
(45) Date of Patent: Aug. 25, 2015

(54) LIQUID EJECTING HEAD, SUBSTRATE FOR LIQUID EJECTING HEAD, AND PRINTING APPARATUS

(71) Applicant: CANON KABUSHIKI KAISHA, Tokyo (JP)

(72) Inventors: Maki Kato, Fuchu (JP); Takahiro Matsui, Yokohama (JP); Nobuyuki Hirayama, Fujisawa (JP); Ichiro Saito, Yokohama (JP); Yuzuru Ishida, Yokohama (JP); Kenji Takahashi, Yokohama (JP); Sadayoshi Sakuma, Oita (JP); Norihiro Yoshinari, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/339,843

(22) Filed: Jul. 24, 2014

(65) Prior Publication Data

US 2015/0029267 A1 Jan. 29, 2015

(30) Foreign Application Priority Data

Jul. 29, 2013 (JP) ..... 2013-156739

(51) Int. Cl.
*B41J 2/15* (2006.01)
*B41J 2/14* (2006.01)

(52) U.S. Cl.
CPC ..... *B41J 2/14072* (2013.01); *B41J 2/14096* (2013.01); *B41J 2/14129* (2013.01)

(58) Field of Classification Search
CPC ..... B41J 2002/14475; B41J 2/14072; B41J 2002/14491; B41J 2/14129; B41J 2/0458; B41J 2/04588; B41J 2/1648
See application file for complete search history.

(56) References Cited

U.S. PATENT DOCUMENTS

| | | | | |
|---|---|---|---|---|
| 6,130,692 | A | 10/2000 | Mochizuki et al. | |
| 6,155,666 | A | 12/2000 | Sugimoto et al. | |
| 6,293,655 | B1 | 9/2001 | Imanaka et al. | |
| 6,443,563 | B1 | 9/2002 | Saito et al. | |
| 6,824,237 | B2 | 11/2004 | Hirayama et al. | |
| 7,309,120 | B2 * | 12/2007 | Hatsui et al. | 347/59 |
| 7,445,316 | B2 * | 11/2008 | Hirayama | 347/58 |
| 7,472,975 | B2 | 1/2009 | Hatsui et al. | |
| 7,591,071 | B2 | 9/2009 | Ibe et al. | |
| 7,681,993 | B2 | 3/2010 | Ono et al. | |
| 7,712,875 | B2 | 5/2010 | Shibata et al. | |
| 7,950,769 | B2 | 5/2011 | Sakai et al. | |
| 8,033,631 | B2 * | 10/2011 | Kanno | 347/17 |
| 8,057,000 | B2 | 11/2011 | Imanaka et al. | |
| 8,075,107 | B2 | 12/2011 | Hatsui et al. | |
| 8,123,330 | B2 | 2/2012 | Sakai et al. | |

(Continued)

FOREIGN PATENT DOCUMENTS

JP 2008-105364 A 5/2008

*Primary Examiner* — Lamson Nguyen
(74) *Attorney, Agent, or Firm* — Fitzpatrick, Cella, Harper & Scinto

(57) ABSTRACT

A print head includes upper protective members located at positions corresponding to heat generating resistor elements to protect the heat generating resistor elements, and further, a part of the protective member can be eluted into ink when a current flows inside in a state in which the ink is stored in the pressure chambers. The print head includes a drive element and a logic circuit capable of allowing a current to independently flow in each of the upper protective layers so as to elute a part of the upper protective layer, in which the current flows, into the ink.

8 Claims, 7 Drawing Sheets

(56) References Cited

U.S. PATENT DOCUMENTS 8,147,039 B2 4/2012 Kurokawa et al.
8,172,371 B2 5/2012 Ishida et al.
8,491,087 B2 7/2013 Sakai et al.
8,646,169 B2 2/2014 Ishida et al.
8,833,889 B2 9/2014 Kanno et al.

* cited by examiner

LIQUID EJECTING HEAD, SUBSTRATE FOR LIQUID EJECTING HEAD, AND PRINTING APPARATUS

BACKGROUND OF THE INVENTION

1. Field of the Invention

The present invention relates to a liquid ejecting head for ejecting liquid so as to perform printing on a print medium, a substrate for a liquid ejecting head, and a printing apparatus.

2. Description of the Related Art

A printing apparatus of an ink jet type having a system for ejecting liquid by use of generation of bubbles produced by thermal energy generated by a heat generating resistor element in liquid is currently adopted in many cases.

In the printing apparatus of this type, a heat generator in the heat generating resistor element during liquid ejection is exposed to high temperature, and further, undergoes a cavitation impact according to bubble formation and shrinkage in liquid or a chemical reaction of ink in combination. Therefore, the heat generating resistor element is provided with an upper protective layer in such a manner as to cover the heat generating resistor element, so as to protect a heat generating resistor portion from the cavitation impact during defoaming or the chemical reaction of ink. Since the temperature rises up to about 700° C. at the surface of the upper protective layer, a colorant, an additive, and the like contained in the ink are heated at high temperature, and then, are decomposed on a molecular level into a slightly soluble substance called "kogation" which may adhere to the surface of the upper protective layer. When the kogation adheres onto the upper protective layer, thermal conduction from the heat generating resistor element to the ink becomes uneven in each region, and therefore, bubble formation may be unstabilized. Moreover, since the thermal conduction from the heat generating resistor element to the ink becomes insufficient by adherence of kogation, the velocity of the ejected ink does not become satisfactory, thereby possibly degrading an ink landing accuracy.

In view of the above-described circumstance, Japanese Patent Laid-Open No. 2008-105364 discloses a print head having an upper protective layer made of iridium or ruthenium. In this print head, in a case where kogation or the like adheres to the surface of the upper protective layer, the surface is dissolved by an electrochemical reaction, thus removing the kogation adhering to the surface of the upper protective layer.

SUMMARY OF THE INVENTION

A liquid ejecting head comprising: a plurality of pressure chambers that can reserve liquid therein; heat generating resistor elements that are arranged in a manner corresponding to each of the pressure chambers, and can heat the liquid reserved in the pressure chambers; a plurality of ejection ports, through which the liquid is ejected by heat generated by the drive of the heat generating resistor elements; a plurality of protective members that are located at positions corresponding to the heat generating resistor elements to protect the heat generating resistor elements, and further, can be eluted to the liquid with the application of a voltage in a state in which the liquid is reserved in the pressure chambers; and a protective member eluting unit that can select a predetermined protective member out of the plurality of protective members and can apply a voltage to the protective member.

Further features of the present invention will become apparent from the following description of exemplary embodiments with reference to the attached drawings.

DESCRIPTION OF THE EMBODIMENTS

In the print head disclosed in Japanese Patent Laid-Open No. 2008-105364, an upper protective layer is arranged in such a manner as to cover all of a plurality of heat generating resistor elements that are arranged in array. As a consequence, when the surface of the upper protective layer is dissolved by an electrochemical reaction, the surface of the upper protective layer is dissolved at one time over all of the heat generating resistor elements that are arranged in array. However, in a printing process, times at which the heat generating resistor elements are driven may be different according to each of the heat generating resistor elements. In a case where the drive times are different according to each of the heat generating resistor elements, there arises a difference in degree of kogation adhering onto the upper protective layer at each of the heat generating resistor elements.

If the surface of the upper protective layer is dissolved according to a heat generating resistor element that is driven relatively few times and has a relatively small degree of adhesion of kogation, the kogation cannot be satisfactorily removed from the heat generating resistor element that is driven many times, thereby possibly degrading the quality of a print image. In contrast, if the surface of the upper protective layer is dissolved according to a heat generating resistor element that is driven relatively many times and has a relatively large degree of adhesion of kogation, the surface of the upper protective layer is unfavorably dissolved although not so much kogation is stuck to a heat generating resistor element that is driven few times. Consequently, unnecessary dissolution of the surface of the upper protective layer makes many upper protective layers consumed in vain, thus possibly shortening the lifetime of the print head.

The present invention has been accomplished in view of the above-described circumstances. An object of the present invention is to provide a liquid ejecting head for eluting the surface of an upper protective layer according to the degree of kogation adhering to each of heat generating resistor elements, a substrate for liquid ejecting head, and a printing apparatus.

A liquid ejecting head and a printing apparatus according to an embodiment of the present invention will be described below with reference to the attached drawings.

Figure 1:
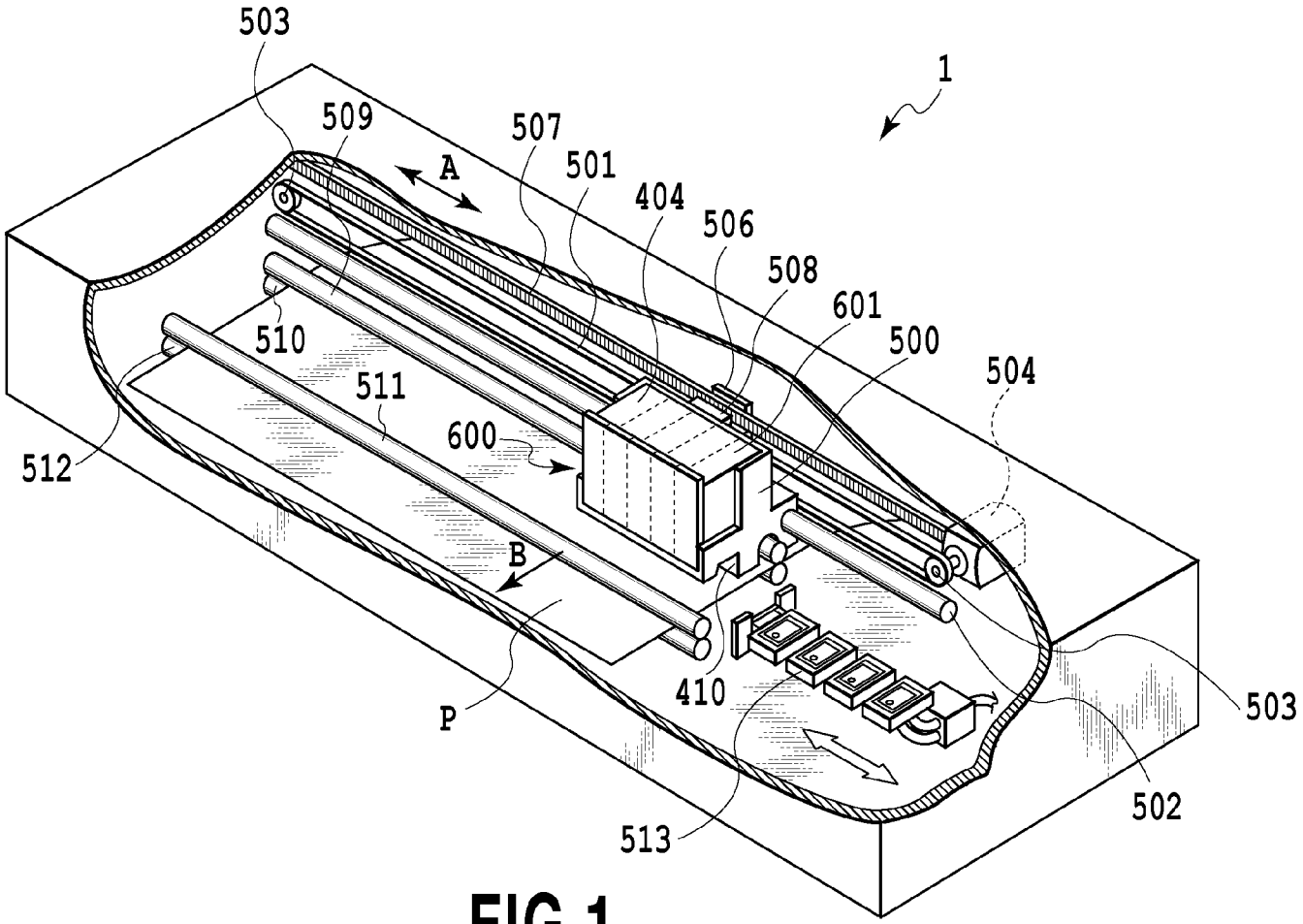
FIG. 1 is a perspective view showing the inside configuration of a printing apparatus according to an embodiment of the present invention.

First, a description will be given of the configuration of a printing apparatus according to an embodiment of the present invention. FIG. 1 is a perspective view showing an ink jet printing apparatus (a printing apparatus) 1 according to an embodiment of the present invention. A print head 600 as a liquid ejecting head according to the present invention and an ink cartridge 404 for reserving or storing therein ink (i.e., liquid) to be supplied to the print head 600 are configured in a manner mountable on a carriage 500 of the ink jet printing apparatus 1. The ink cartridge 404 is detachably attached to the carriage 500. Here, the print head 600 and the ink cartridge 404 may be formed integrally with each other.

The ink jet printing apparatus 1 can perform color printing. Four ink cartridges 404 that contain magenta (M), cyan (C), yellow (Y), and black (K) inks, respectively, are mounted on the carriage 500. These four ink cartridges 404 can be detachably attached independently of each other.

The carriage 500 and the print head 600 are configured such that respective electric contact portions of the members are properly brought into contact with each other so that the members are electrically connected to each other. The print head 600 is adapted to apply energy to a plurality of ejection ports in response to a print signal to selectively eject the ink from the ejection ports to a print medium, thus performing printing. In particular, the print head 600 in the present embodiment adopts an ink jet system in which the ink is ejected by the use of thermal energy.

A guide shaft 502 is disposed in such a manner as to extend in a main scanning direction of the carriage 500 in the ink jet printing apparatus 1. The guide shaft 502 is inserted into the carriage 500, and thus, the carriage 500 is supported by the guide shaft 502. In this manner, the carriage 500 is slidably guided and supported along the guide shaft 502 in a direction indicated by a double-headed arrow A.

The carriage 500 is fixedly connected to a part of an endless belt 501. The endless belt 501 is wound around pulleys 503 and 503. A drive shaft of a carriage driving motor 504 is coupled to one of the pulleys 503. The carriage 500 mounting the print head 600 thereon is reciprocated along the guide shaft 502 by the drive force of the carriage driving motor 504. In this manner, the carriage 500 is reciprocated along the guide shaft 502 in the main scanning direction that traverses the conveyance direction of the print medium by the forward and reverse rotations of the carriage motor 504.

Moreover, a linear encoder 506 is provided in the ink jet printing apparatus 1 for the purpose of the detection of the movement position of the carriage in the main scanning direction. One constituent element for the linear encoder 506 is a linear scale 507 disposed along the movement direction of the carriage 500. Slits are formed on the linear scale 507 at equal intervals in a predetermined density. In addition, other constituent elements for the linear encoder 506 such as a slit detection system 508 having a light emitter and a light receiving sensor and a signal processing circuit are provided in the carriage 500. Consequently, an ejection timing signal for defining an ink ejection timing and positional information on the carriage are output from the linear encoder 506 according to the movement of the carriage 500.

The print head 600 scans a print medium P in the main scanning direction while ejecting the ink, thus performing printing over the entire width of the print medium P. Furthermore, a platen is disposed in the ink jet printing apparatus 1 in a manner facing an ejection port surface, at which the ejection ports of the print head 600 are formed. A print sheet P as the print medium is intermittently conveyed in a direction indicated by an arrow B, perpendicular to the main scanning direction of the carriage 500. The ink jet printing apparatus 1 has a conveyance roller unit to be driven by a conveyance motor, not shown, for conveying the print medium P. A pair of roller units 509 and 510 disposed upstream in a conveyance direction and a pair of roller units 511 and 512 disposed downstream are arranged in the ink jet printing apparatus 1 as the conveyance roller unit. The print medium P as the print sheet is supported by the roller units 509 and 510 and the roller units 511 and 512, and is conveyed with the application of a predetermined tension. Consequently, the flatness of the print medium is secured with respect to the print head 600. The drive force with respect to each of the roller units is transmitted from the conveyance motor, not shown.

The carriage 500 stops at a home position, as required, at the beginning of printing or during printing. A cap member 513 for capping the surface (i.e., the ejection port surface) having the ejection ports of each of the print heads 600 formed thereat is disposed at the home position. The cap member 513 is so configured as to cap the ejection ports of the print head 600 so as to receive ink ejected from the print head 600. In a state in which the ejection ports of the print head 600 are capped with the cap member 513, preliminary ejection with a pigment ink is performed. The ink is sucked inside of a cap, so that the pigment ink ejected during the preliminary ejection can be collected. In this manner, suction recovery means, not shown, for forcibly sucking the ink from the ejection port and preventing the ejection port from clogging is connected to the cap member 513.

Figure 2:
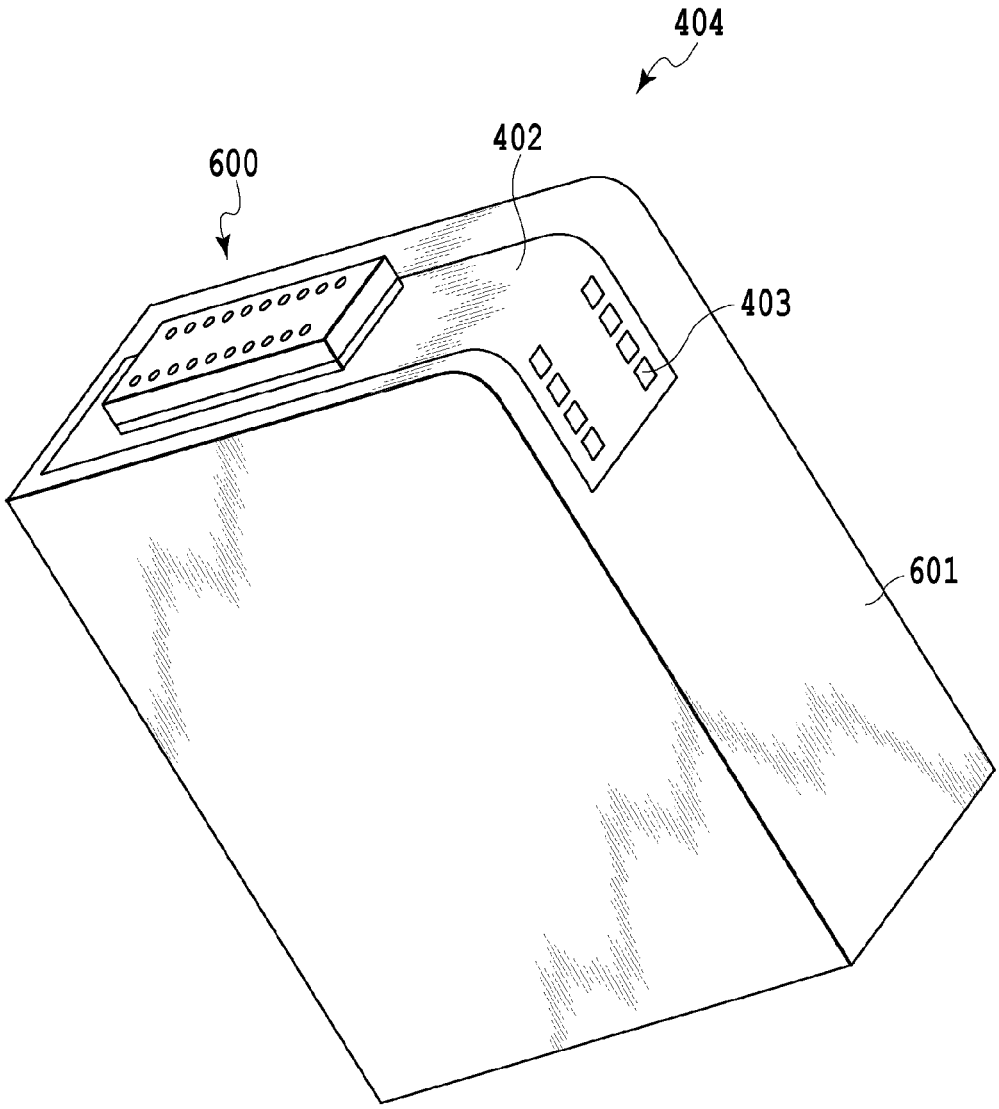
FIG. 2 is a perspective view showing a print head and an ink cartridge mounted on the printing apparatus shown in FIG. 1.

Next, explanation will be made on the configurations of the print head 600 and the ink cartridge 404. Here, a description will be given of the ink cartridge 404 in a cartridge mode, in which the print head 600 and an ink tank 601 are integrated with each other. FIG. 2 is a perspective view showing the ink cartridge 404 having the print head 600 and the ink tank 601 formed integrally with each other. A tape member 402 for TAB (Tape Automated Bonding) having a terminal for supplying electric power to the print head 600 is adhered onto the ink cartridge 404. The tape member 402 is connected to the print head 600. The electric power is supplied to the print head 600 from voltage applying means disposed in the main body of the ink jet printing apparatus 1 via a contact point 403.

Incidentally, the print head is not limited to the type of ink cartridge at which the print head is integrated with the ink tank, as described above. For example, the print head may be of a type in which an ink tank is separably disposed, so that only the ink tank is detached, and then, a new ink tank is attached when the ink tank is empty of the ink. Alternatively, a print head may be configured independently of an ink tank, and ink is supplied to the print head via a tube or the like. Moreover, the print head may be one to be applied to a serial print system, or a full line system to be applied to a line printer capable of ejecting ink over a range corresponding to the entire width of a print medium.

Figure 3:
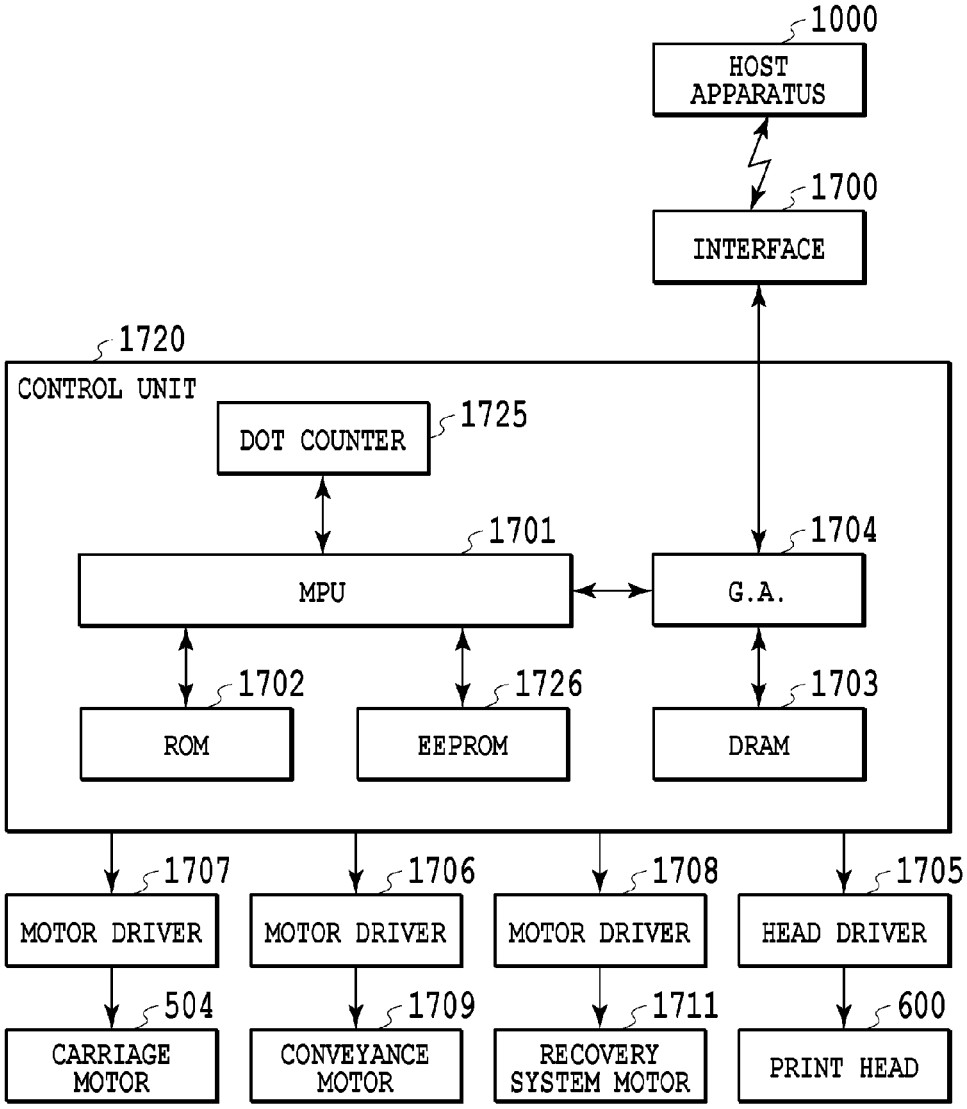
FIG. 3 is a block diagram illustrating the configuration of a control system of the printing apparatus shown in FIG. 1.

FIG. 3 is a block diagram illustrating the configuration of a control system in the ink jet printing apparatus 1 having the above-described configuration.

As illustrated in FIG. 3, a control unit 1720 in the ink jet printing apparatus 1 is provided with an MPU 1701, a ROM 1702, and an EEPROM 1726. The ROM 1702 and the EEPROM 1726 can serve as data storage means, and therefore, can store data therein. The data stored in the ROM 1702 and the EEPROM 1726 includes data on drive conditions for the print head 600 such as a shape of a drive pulse to be applied to a heat generator 104', application time, a voltage to be applied to an upper protective layer 107 and its duration, for example. Additionally, the data stored in the ROM 1702 and the EEPROM 1726 may include data on conditions for conveyance of the print medium, and further, a carriage speed.

The MPU 1701 controls each of the component parts housed inside of the ink jet printing apparatus 1 according to a control program or required data stored in the ROM 1702. The MPU 1701 is connected to a gate array (abbreviated as "G.A.") 1704. Moreover, a DRAM 1703 is connected to the gate array 1704. The MPU 1701 and the DRAM 1703 are connected to each other via the gate array 1704.

The gate array 1704 transfers the data among an interface 1700, the MPU 1701, and the DRAM 1703. The gate array 1704 is connected to the interface 1700, and then, the ink jet printing apparatus 1 is connected to a host apparatus 1000 via the interface 1700. When image data is input into the MPU 1701 from the external host apparatus 1000, the image data is input into the gate array 1704 via the interface 1700, and then, is input into the MPU 1701 from the gate array 1704.

The DRAM 1703 stores therein various kinds of data (such as the print signal or print data to be supplied to the head), and further, has a region for a flag to be used during control, described later, or the like. The gate array 1704 controllably supplies print data with respect to the print head, and further, controllably transfers the data among the interface 1700, the MPU 1701, and the DRAM 1703. A dot counter 1725 is designed to count the number of ink ejection times (i.e., the number of dots) every printing operation. The EEPROM 1726 is a nonvolatile memory for storing the required data also when the power source of the printing apparatus is turned off.

The control unit 1720 is adapted to receive the print signal including a command or image data to be sent, via the interface 1700, from the external host apparatus 1000 in an appropriate form of a computer, a digital camera, or a scanner. Moreover, the control unit 1720 sends status information on the printing apparatus to the host apparatus 1000, as required.

A conveyance motor 1709 is used as a drive source for conveying the print sheet P. A recovery system motor 1711 is used as a drive source for performing the capping operation by the cap member 513 and operating suction recovery means such as a pump for recovering suction. Here, a transmission mechanism may be properly configured such that only one motor fulfills the functions of the conveyance motor 1709 and the recovery system motor 1711. A head driver 1705 is designed to drive the print head 600.

The head driver 1705 is adapted to drive the print head 600 in response to the print signal output from the control unit 1720, and then, the print head 600 ejects the ink. A motor driver 1706 drives the conveyance motor 1709 in response to a signal output from the control unit 1720, so that the conveyance roller units perform conveyance operation of the print medium. Another motor driver 1707 drives the carriage motor 504 so as to move the print head 600 to a predetermined print position in the main scanning direction in response to a signal output from the control unit 1720. A further motor driver 1708 drives the recovery system motor 1711 in response to a signal output from the control unit 1720, so that recovery means recovers the print head 600.

Additionally, the gate array 1704 and the MPU 1701 in the control unit 1720 convert image data received from the external host apparatus 1000 via the interface 1700 into print data, and then, store it in storage means. Moreover, the control unit 1720 drives the motor drivers 1706 and 1707 and the head driver 1705 in synchronism with each other, thus achieving the printing operation of the print head 600, the conveying operation of the print medium, and the reciprocating motion of the print head 600 in the main scanning direction. In this manner, a print image in accordance with the print data is formed on the print medium, and consequently, printing is performed on the print medium.

Subsequently, a description will be given of the configuration of the print head 600 in the present embodiment.

Figure 4:
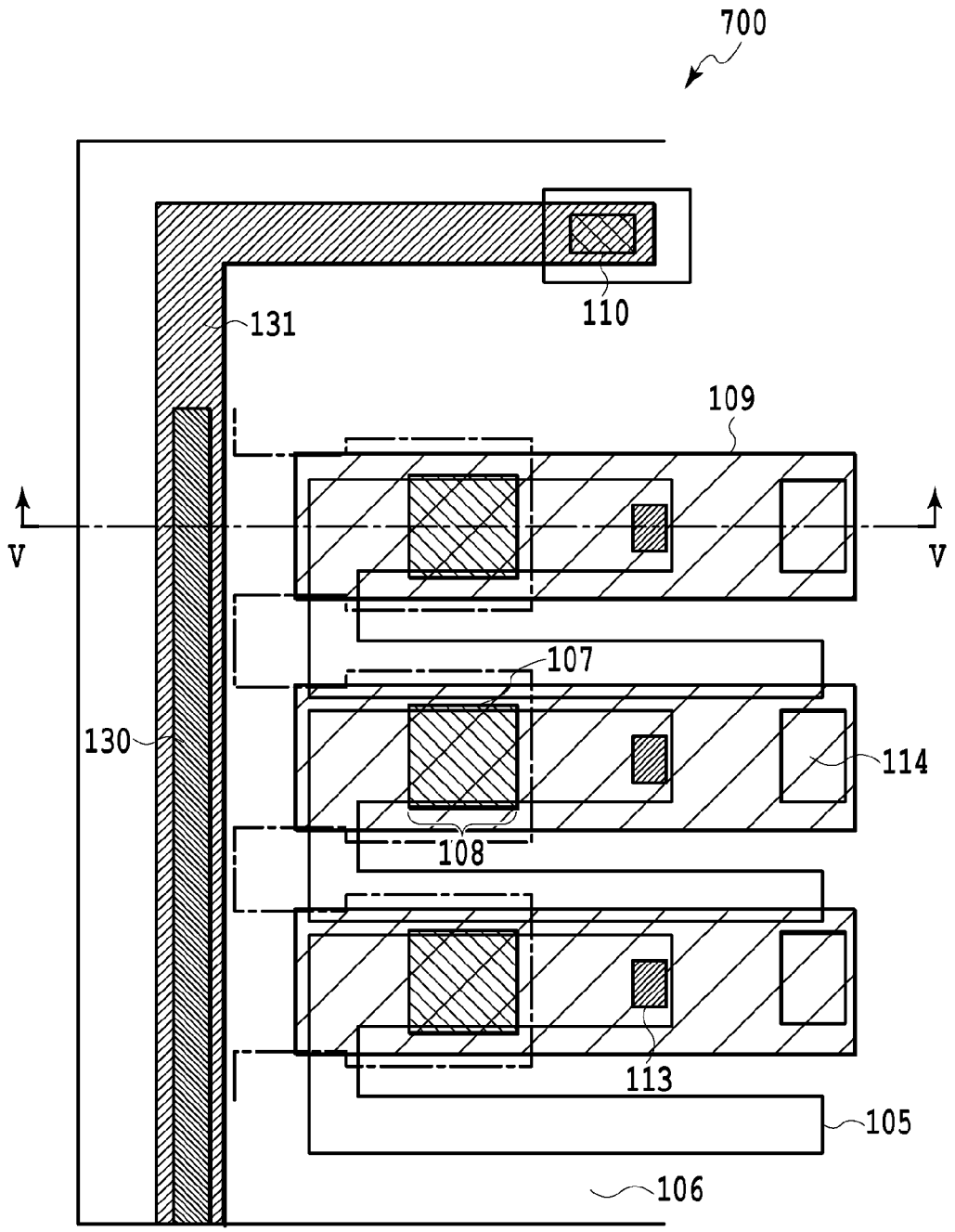
FIG. 4 is a plan view schematically showing the print head shown in FIG. 2.
Figure 5:
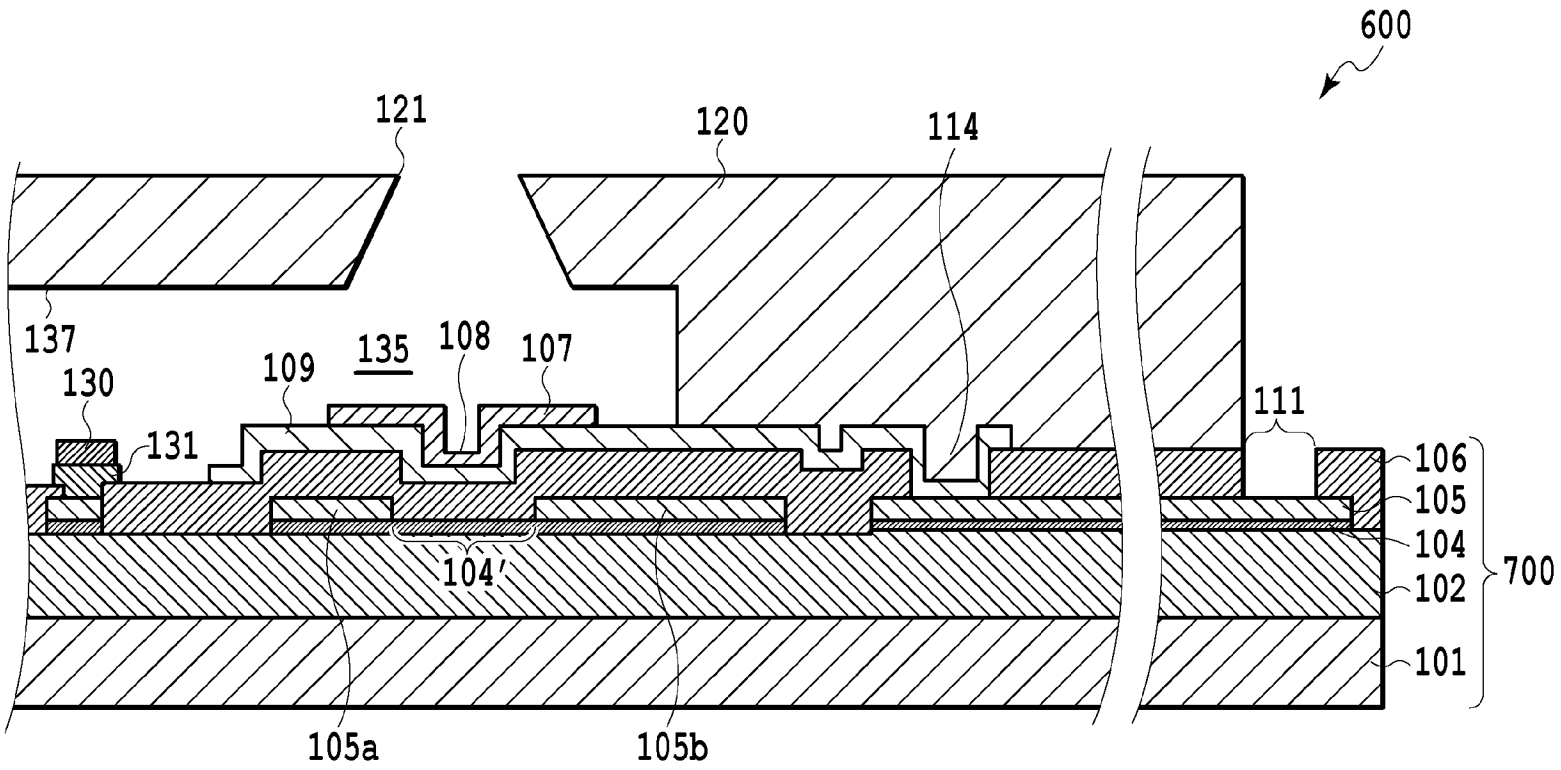
FIG. 5 is a cross-sectional view taken along a line V-V in the print head shown in FIG. 4.

FIG. 4 is a schematic plan view showing the vicinity of a heat generator in a substrate for print head (i.e., a substrate for liquid ejecting head) 700 to be used in a print head 600 according to the present embodiment. FIG. 5 is a schematic cross-sectional view taken along a line V-V in the substrate for print head 700 shown in FIG. 4. As shown in FIG. 5, the substrate for print head 700 has a thermal storage layer 102, the heat generating resistor layer 104, an electrode wire layer 105, a protective layer 106, and the like that are formed in lamination on a base 101 made of silicon. The thermal storage layer 102 is made of a thermal oxide film, an SiO film, an SiN film, or the like. Moreover, the heat generating resistor layer 104 is laminated on the thermal storage layer 102.

The electrode wire layer 105 is made of a metallic material such as Al, Al—Si, or Al—Cu as a wire for allowing a current to pass therethrough. Moreover, the electrode wire layer 105 is partly removed at a position corresponding to a heat generator 104' serving as a heat generating resistor element, thus defining a gap between electrode wire layers 105*a* and 105*b*. In this manner, the heat generating resistor layer 104 at that portion is exposed, thus forming the heat generator 104'. A part of the upper protective layer 107 positioned above the heat generator 104' functions as a heat acting portion of a heat generating resistor element 108 for allowing heat generated by the heat generator 104' to act on the ink. The electrode wire layer 105 is connected to a drive element circuit, not shown, or an external electrode 111, and thus, can receive power supply from the outside. Incidentally, although the electrode wire layer 105 is laminated on the heat generating resistor layer 104 in the illustration, another configuration in which an electrode wire layer is formed on a base, and then, is partly removed to define a gap, thus achieving a heat generating resistor layer may be adopted.

The protective layer 106 is formed above the heat generating resistor layer 104, and thus, functions also as an insulating layer made of an SiO film or an SiN film. The upper protective layer (i.e., a protective member) 107 is adapted to protect the heat generating resistor element from chemical and physical impacts according to the heat generation at the heat generator 104', and further, is eluted into the ink when a voltage is applied for removing kogation in cleaning, as described later.

In the present embodiment, metal that is eluted by an electrochemical reaction in the ink, specifically, Ir (iridium) is used as the upper protective layer 107. Ir used as the upper protective layer 107 generally has low adhesion property to other members. Therefore, an intermediate layer 109 as an adhesion layer for enhancing adhesion property between the upper protective layer 107 and the protective layer 106 is interposed between the protective layer 106 and the upper protective layer 107 in the present embodiment. The intermediate layer 109 is interposed between the protective layer 106 and the upper protective layer 107, for enhancing adhesion property of the upper protective layer 107 to the protective layer 106. Moreover, the intermediate layer 109 also functions as a wire for electrically connecting the upper protective layer 107 to the external electrode 111, and is made of a conductive material.

The intermediate layer 109 is connected to the electrode wire layer 105 via a through hole 114. The electrode wire layer 105 extends near the end of the base 101 of the substrate for print head 700, and further, the external electrode 111 is formed at the end so that the end achieves the electric connection to the outside. Moreover, a through hole 113 is formed at an end opposite to the external electrode 111 on the electrode wire layer 105. A current is allowed to flow in the external electrode 111 via the through hole 113 and the wire, thereby allowing the current to flow in the electrode wire layer 105.

Furthermore, an electrode member 130 is made of the same material as that of the upper protective layer 107 formed at the position corresponding to the heat generator 104' at the position of an ink path on a side of an ink supply port 136 (referring to FIG. 6) apart from the heat generator 104'. The electrode member 130 functions as a counter electrode when the electrochemical reaction is conducted. Additionally, a wire member 131 made of the same material as that of the intermediate layer 109 is laminated under the electrode member 130. The electrode member 130 is connected to the external electrode via the wire member 131 and the through hole 110.

A flow path forming member 120 is mounted on the substrate for print head 700 in order to form a path 137, through which ink communicates with an ejection port 121 from the ink supply port 136 via the heat generating resistor element 108. In the flow path forming member 120, the ejection port 121 is formed at a position corresponding to the heat generating resistor element 108. The flow path forming member 120 is mounted on the substrate for print head 700, thereby defining a pressure chamber 135 capable of reserving ink therein. Inside of the print head 600, the plurality of pressure chambers 135 are formed in such a manner as to correspond to the plurality of ejection ports 121, respectively. The ink supply port 136 is formed in the substrate for print head 700 in such a manner as to penetrate the substrate for print head 700.

With the print head 600 having the above-described configuration, the current is allowed to flow in the electrode wire layer 105 via the external electrode 111, and then, the current can flow at the position where the gap is defined by partly removing the electrode wire layer 105. Consequently, the current flows at the position corresponding to the heat generator 104', in the heat generating resistor layer 104. A voltage is applied to the heat generating resistor element 108, and thus, the heat generating resistor element 108 can be driven to generate heat. The ink staying in the pressure chamber 135 is heated by thermal energy generated at the heat generating resistor element 108 at this time, and then, bubbles are generated in the ink by film boiling. Ink droplets are ejected from the ejection ports 121 by the bubble forming energy generated at this time.

Moreover, when the print head 600 is filled with the ink, the electrode member 130 and the upper protective layer 107 are turned into a conductive state via the ink.

The upper protective layer 107 and the electrode member 130 are not electrically connected to each other in the state in which the print head 600 is not filled with the ink. However, as described above, when a region above the substrate is filled with the ink as a solution containing an electrolyte, the upper protective layer 107 and the electrode member 130 are turned into a conductive state via the solution. And then, the voltage is applied between the upper protective layer 107 and the electrode member 130 via the external electrode connected to the upper protective layer 107 and the external electrode connected to the electrode member 130, so that an electrochemical reaction occurs at the interface between the upper protective layer 107 and the solution.

Here, the upper protective layer 107 is made of Ir that cannot form an oxide film under 800° C. even in the atmosphere. Therefore, even if heat is generated at the heat generator 104', no oxide film is formed at a position corresponding to the heat generator 104' on the upper protective layer 107. In this manner, a potential can be uniformly applied to the ink from the upper protective layer 107 in the state in which there is no oxide film. Since the voltage is applied between the electrode member 130 and the upper protective layer 107, the surface of the upper protective layer 107 is eluted into the ink because of the electrochemical reaction occurring between the surface of the upper protective layer 107 and the ink. In other words, the voltage is applied to the upper protective layer 107, so that the surface of the upper protective layer 107 can be eluted into the ink.

The surface of the upper protective layer 107 is eluted into the ink, and therefore, in a case where kogation is deposited on the heat generating resistor element 108, the kogation can be removed. In the present embodiment, the potential can be uniformly applied to the ink from the upper protective layer 107 in the state in which there is no oxide film, thus efficiently removing the kogation from the heat generating resistor element 108.

Moreover, the electrochemical reaction between the upper protective layer 107 and the ink is the utilized in the present embodiment in order to remove the deposit on the heat generating resistor element 108. For the purpose of this, the through hole 114 is formed at the protective layer 106, so that the upper protective layer 107 and the electrode wire layer 105 are electrically connected to each other via the intermediate layer 109. Since the electrode wire layer 105 is connected to the external electrode 111, the upper protective layer 107 and the external electrode 111 are electrically connected to each other.

The ink for use in printing contains an electrolyte. Additionally, the upper protective layer 107 is made of Ir in the present embodiment. Thus, the electrochemical reaction or the elusion can occur as long as the ink exists on the upper protective layer 107 at the position. At this time, the elusion of the metal occurs on the side of an anode electrode. Therefore, in order to remove the kogation from the heat generating resistor element 108, the potential is applied such that the upper protective layer 107 is on an anode side whereas the electrode member 130 is on a cathode side.

In addition, according to the present invention, as shown in FIG. 4, the intermediate layer 109 serving as the wire layer is independently connected per bit, that is, for each of the heat generating resistor elements 108, to the upper protective layer 107 arranged at the position corresponding to the heat generating resistor element 108. Consequently, the kogation can be independently removed at each of the ejection ports in response to a kogation removal signal.

Additionally, the electrode member 130 made of Ir is arranged on the side of the ink supply port 136 as the counter electrode in achieving the electrochemical reaction in the present embodiment. In other words, as for the electrode member 130 arranged on the side of the ink supply port 136, the electrode member is made of Ir. Incidentally, an electrode member may be made of other materials as long as a favorable electrochemical reaction can be achieved via the solution (i.e., the ink).

Furthermore, although Ir is used for the upper protective layer 107 in the above-described configuration, other substances may be used as an upper protective layer as long as a main element is a metal that is eluted by an electrochemical reaction, and further, an oxide film that inhibits elution by heat is not formed. For example, Ru (ruthenium) may be used for an upper protective layer.

In the present embodiment, the upper protective layer 107 formed at the position corresponding to the heat generating resistor element 108 is connected to the external electrode 111 via the intermediate layer 109 and the electrode wire layer 105 without any contact with the flow path forming member 120, thus applying the potential to the ink. Even if the upper protective layer 107 is eluted by the electrochemical reaction occurring at this time, a problem of degradation of the adhesion property between the flow path forming member 120 and the substrate for print head 700 does not arise. This is because the flow path forming member 120 is in contact with the intermediate layer 109, and further, Ta is used for the intermediate layer 109 in the present embodiment. As described above, when an electrochemical reaction is forced to occur in the ink, an oxide film is formed at a surface by anodic oxidation, and therefore, Ta cannot be substantially eluted.

Figure 6:
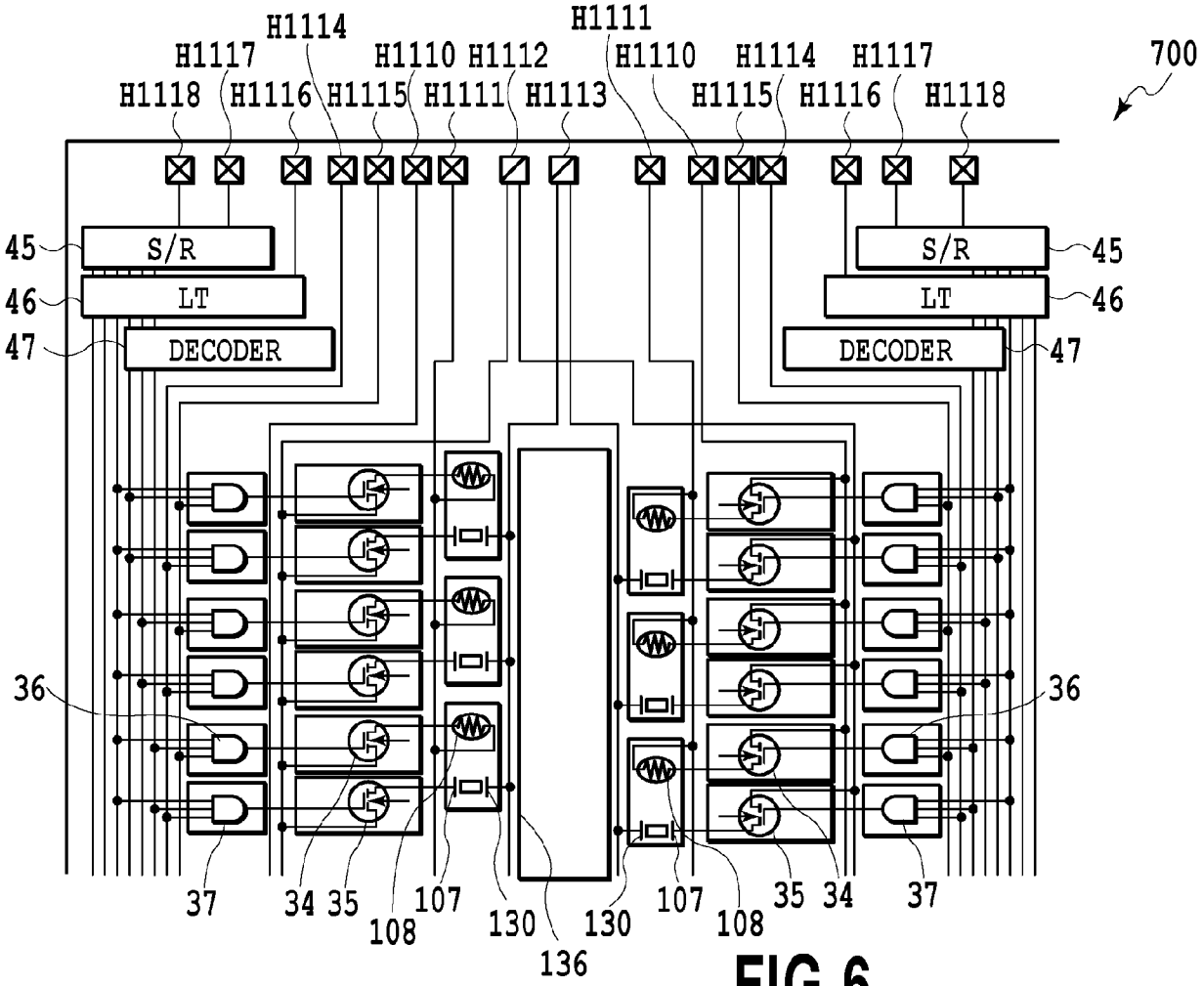
FIG. 6 is a plan view schematically showing a logic circuit and a wire in the print head shown in FIG. 5.
Figure 7:
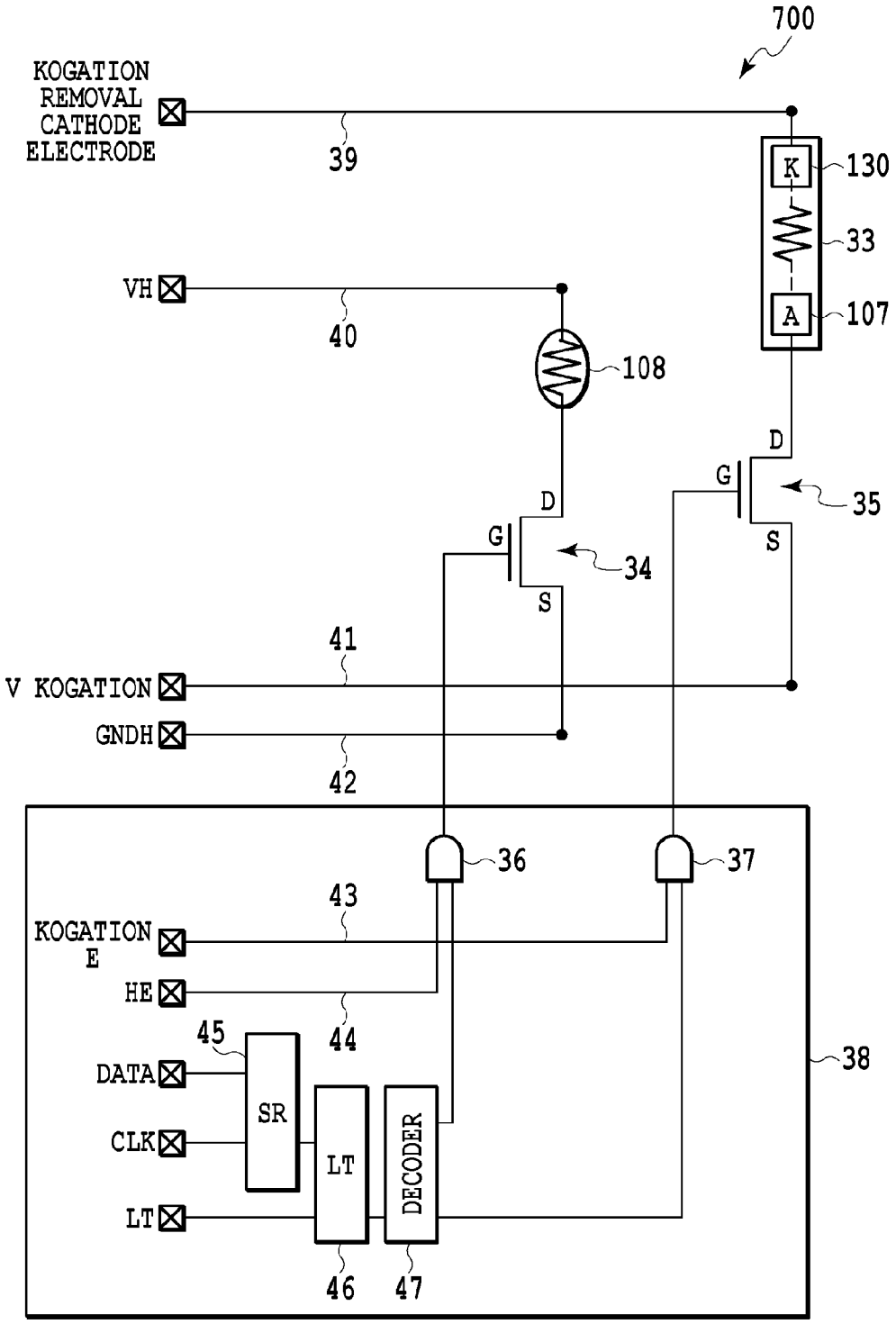
FIG. 7 is a diagram explanatory of the configuration of the circuit in the print head shown in FIG. 6.

Referring to FIGS. 6 and 7, a description will be given of a circuit for the print head in the present embodiment. FIG. 6 is a plan view schematically showing the configuration of the circuit in the print head of the present embodiment. FIG. 7 is a circuit diagram explanatory of the circuit for the print head shown in FIG. 6.

The plurality of heat generating resistor elements 108 are formed on the substrate for print head 700. Each of the heat generating resistor elements 108 is connected to a logic circuit 38 via a drive element 34. The logic circuit 38 includes a shift register (S/R) 45, a latch circuit (LT) 46, and a decoder (DECODER) 47. The drive element 34 provided for switching the ON and OFF of the current to the heat generating resistor element 108 is disposed at each of the heat generating resistor elements 108. Moreover, a power source VH is connected to one end of a wire connected to the heat generating resistor element 108. A logic gate 36 is connected to the drive element 34. In contrast, one end of the wire connected to the drive element 34 on a side opposite to the heat generating resistor element 108 is connected to a ground GNDH. When a heat enable (HE) signal is sent through the logic gate 36, the drive element 34 is turned on and in a state that the current is permitted to flow, thus applying the voltage to the heat generating resistor element 108.

The logic circuit 38 allows the current to be supplied to a predetermined heat generating resistor element 108 out of the plurality of heat generating resistor elements 108 so as to eject the ink, and further, controls each of drive of the heat generating resistor element 108. In the logic circuit 38, the print data transferred from the MPU 1701 is serially transferred to the shift register 45 in synchronism with a clock signal CLK. In this manner, the shift register 45 stores data on the heat generating resistor element 108, in which the current should flow, in a manner corresponding to the plurality of heat generating resistor elements 108. The print data output from the shift register 45 is latched by the latch circuit 46. In this manner, the latch circuit 46 latches the data, which is output from the shift register 45, on the heat generating resistor element 108, in which the current should flow. The print data latched in the latch circuit 46 is input into the decoder 47, from which the print data is input into the logical gate 36. The logic circuit 38 is provided with the logic gate 36 serving as an AND circuit for outputting a logical conjunction between latch data output from the latch circuit 46 and the heat enable signal (HE) output from the MPU 1701. The logic circuit 38 supplies a drive current to the heat generating resistor element corresponding to the ejection port belonging to a block to be driven at an ejection port array based on the heat enable signal as an output selection signal and the print data as a digital image signal output through a terminal DATA. Specifically, the logic circuit 38 switches the ON and OFF of the drive element 34 in response to an output from the logic gate 36 serving as the AND circuit for outputting the logical conjunction between the selection signal and the print data, so as to switch the supply and cutoff of the drive current with respect to the heat generating resistor element. The supply and cutoff of the current with respect to the heat generating resistor element control the ejection and non-ejection of the ink, so as to print an image. In this manner, the logic circuit 38 functions as a circuit for controlling the drive of each of the heat generating resistor elements 108 (i.e., a drive control circuit).

The upper protective layer 107 serving as a kogation removal electrode is mounted at upper portion of the plurality of heat generating resistors 104' via the protective layer 106. The electrode member 130 serving as the counter electrode that becomes a cathode electrode at the time of removal of kogation is formed at a position apart from the upper protective layer 107. Moreover, a drive element (i.e., switch means) 35 provided for switching the ON and OFF of the voltage to be supplied between the upper protective layer 107 and the electrode member 130 is provided for each of the upper protective layers 107 and each of the electrode members 130. The drive element 35 can switch the supply and cutoff of the voltage to each of the upper protective layers 107. A logic gate 37 is connected to the drive element 35. When an enable (kogation E) signal regarding kogation removal is sent to the logic gate 37, the current can flow in the drive element 35, and then, the voltage is applied between the upper protective layer 107 serving as a kogation removal electrode and the electrode member 130. The upper protective layer 107 is connected to an anode wire 41 whereas the electrode member 130 is connected to a cathode wire 39.

The heat generating resistor element 108 and the upper protective layer 107 are connected to the logic circuit (i.e., the control circuit) 38 via the drive elements 34 and 35, respectively. The logic circuit 38 can control the switch between the supply and cutoff of the voltage at the drive element 35. The logic circuit 38 includes the logic gate 37 capable of sending, to the drive element 35, a signal for allowing the application of the voltage between the upper protective layer 107 and the electrode member 130.

The voltage is applied between the upper protective layer 107 and the electrode member 130, thereby eluting the surface of the upper protective layer 107 into the ink, so as to remove the kogation adhering to the upper protective layer 107. Also during this kogation removal, the logic circuit 38 is used. During the kogation removal, data with respect to the upper protective layer 107 whose kogation is removed is serially input into the logic circuit 38 from the terminal DATA. In the logic circuit 38, the transferred serial data on the kogation removal is converted into a parallel signal in the shift register 45, and then, is latched to the latch circuit 46. In this manner, the shift register 45 stores therein the data with respect to the upper protective layer 107, to which the voltage should be applied, in a manner that the upper protective layer corresponds to each of the plurality of heat generating resistor elements 108. The latch circuit 46 latches the data, which is output from the shift register 45, with respect to the upper protective layer 107, to which the voltage should be applied. The data with respect to the kogation removal, latched in the latch circuit 46, is input into the decoder 47. And then, from the decoder 47, the data with respect to the upper protective layer 107 whose kogation is removed is input to the logic gate 37. The logic circuit 38 applies the voltage for removing the kogation between the upper protective layer 107 corresponding to the ejection port that should be subjected to the kogation removal and the electrode member 130, based on the enable signal (i.e., KOGATION E) as the output selection signal and the data with respect to the kogation removal, output from the terminal DATA. Specifically, the logic circuit 38 switches the ON and OFF of the drive element 35 in response to the output from the logic gate 37 serving as the AND circuit for outputting the logical conjunction between the selection signal and the data with respect to the kogation removal, thus switching the supply and cutoff of the voltage with respect to the upper protective layer 107. The kogation removal is controlled by control of the supply and cutoff of the voltage to the upper protective layer 107. When the signal for allowing the voltage to be applied to the upper protective layer 107 is sent to the logic gate 37, and further, the data with respect to the upper protective layer, to which the voltage should be applied, is sent to the logic gate 37, the drive element 35 applies the voltage to between the upper protective layer 107 and the electrode member 130. That is to say, the logic circuit 38 and the drive element 35 can selectively apply the voltage to the upper protective layer 107.

When the removal of kogation is performed, the region between the upper protective layer 107 and the electrode member 130 as the cathode electrode are filled with an ink 33. Consequently, when the logic gate 37 becomes Enable and the drive element 35 is turned ON, the voltage is supplied to the upper protective layer 107, and thus, the upper protective layer 107 is eluted by the electrochemical reaction with the ink, and as a result, the kogation removal is performed. In the present embodiment, an electrode H1110 shown in FIG. 6 is used as the ground electrode GNDH. Moreover, an electrode H1111 is connected to the power source VH; an electrode H1112 is connected to the upper protective layer 107; and an electrode H1113 is connected to the electrode member 130.

In this manner, in the present embodiment, the logic circuit 38 and the drive element 35 (i.e., protective member eluting means) can select the upper protective layer 107, to which the voltage should be applied. Thus, the voltage is independently applied to each of the upper protective layers 107, so that a part of the upper protective layer 107, to which the voltage is applied to between the electrode member 130 and the upper protective layer 107, can be eluted in the ink.

Explanation will be made on the degree of the drive of the upper protective layer 107 when the surface of the upper protective layer 107 is eluted with the application of the voltage to the upper protective layer 107 so as to remove the kogation. A kogation removal experiment was conducted with respect to the print head using the substrate for ink jet print head. First, the heat generating resistor element 108 was driven under a predetermined condition in such a manner as to deposit kogation on the heat generating resistor element 108, and then, the voltage was applied to the upper protective layer 107, thus conducting kogation removal processing. A dye ink was used as the ink.

First, a current was applied to a heat generating resistor element $5.0\times10^8$ times with a drive pulse having a voltage of 24 V, a width of 0.8 μsec, and a frequency of 15 kHz. Impurities called kogation were almost uniformly deposited on the heat generating resistor element 108. In this manner, the current was repeatedly applied to the heat generating resistor element, so that kogation was allowed to adhere onto the upper protective layer 107 corresponding to the heat generating resistor element. When printing is performed with the print head in the above-described state, it was confirmed that the quality of printing was reduced since the kogation was deposited on the heat generating resistor element.

Next, a voltage of 10 V was applied to the external electrode 111 connected to the upper protective layer 107. And then, kogation removal enable signal was sent for 10 seconds, so that the kogation was removed from the upper protective layer 107, on which the kogation was deposited. Thereafter, when printing was performed with the print head in this state, it was confirmed that the print quality was restored to substantially the same level as the initial level. Moreover, when the status of the heat generating resistor element 108 was observed by a metallurgical microscope after the kogation was removed from the print head, it was found that the kogation deposited so far was favorably removed from the upper portion of the heat generating resistor element.

In the above-described embodiment, the upper protective layer 107, from which the kogation is removed, can be selected at each of the ejection ports corresponding thereto by using the circuit including the shift register and the latch in the logical circuit for selecting the heat generating resistor element to be driven, the wire, or the terminal. Therefore, the voltage applied across the upper protective layer 107, from which the kogation is removed, can be independently supplied or cut off at each of the ejection ports. Since at each of the ejection ports, the kogation can be removed from the upper protective layer corresponding to the ejection port, the kogation can be removed according to the level of the material adhering to the upper protective layer at each of the ejection ports.

Since the kogation can be removed according to the adhesion level of the kogation at each of the ejection ports, the kogation can be removed at a frequency suitable for the adhesion condition of the kogation at each of the ejection ports. Consequently, it is possible to prevent the kogation from being insufficiently removed from the heat generating resistor element that is driven many times due to the insufficient frequency of the kogation removal, thus suppressing the degradation of a print image. Moreover, it is possible to suppress the dissolution of the surface of the upper protective layer that has no adhesion of kogation because of the excessive frequency of the kogation removal. In this manner, it is possible to suppress the deterioration of the durability of the print head caused by the unnecessary consumption of many upper protective layers due to the unnecessary dissolution of the surface of the upper protective layer.

Additionally, the present embodiment is configured such that the common circuit is used for both selecting the upper protective layer, from which the kogation is removed, from the plurality of upper protective layers, and selecting the heat generating resistor element to be driven from the plurality of heat generating resistor elements. Therefore, with the existing configuration, the upper protective layer, from which the kogation is removed, can be selected from the plurality of upper protective layers without additionally housing, inside of the print head, a configuration for selecting the upper protective layer, from which the kogation is removed, from the plurality of upper protective layers. Consequently, the kogation can be independently removed at each of the ejection ports without increasing the size of the substrate in the print head. Thus, it is possible to miniaturize the print head, and further, suppress the manufacturing cost of the print head to a lower level.

Here, the print head in the above-described embodiment can be mounted on apparatuses such as a printer, a copying machine, a facsimile machine having a communication system, and a word processor having a printer unit and printing apparatuses compositely combined with various kinds of processing apparatuses. The use of this print head enables printing on various print mediums such as paper, yarn, fiber, cloth, leather, metal, plastic, glass, wood, and ceramic. Incidentally, "printing" in the present specification signifies not only applying a significant image such as a character or graphics to a print medium but also applying an insignificant image such as a pattern.

According to the present invention, the elution of the protective member can be carried out at a proper timing at each of the protective members according to the level of the adhesion of the kogation to the protective member. Thus, it is possible to securely remove the kogation adhering to the protective member, and further, enhance the durability of the protective member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-156739, filed Jul. 29, 2013 which is hereby incorporated by reference herein in its entirety.

What is claimed is:

1. A liquid ejecting head comprising:

a plurality of pressure chambers that can store liquid therein;

heat generating resistor elements that are arranged in a manner corresponding to each of the pressure chambers, and can heat the liquid stored in the pressure chambers;

a plurality of ejection ports, through which the liquid is ejected by heat generated by the drive of the heat generating resistor elements;

a plurality of protective members that are located at positions corresponding to the heat generating resistor elements to protect the heat generating resistor elements, and further, can be eluted into the liquid with the application of a voltage in a state in which the liquid is stored in the pressure chambers; and a protective member eluting unit that can select a predetermined protective member out of the plurality of protective members and can apply a voltage to the predetermined protective member.

2. The liquid ejecting head according to claim 1, wherein the protective member eluting unit includes:

a switching unit that is connected to each of the plurality of protective members to switch the supply of the voltage to the predetermined protective member; and a control circuit configured to control the switch in the switching unit.

3. The liquid ejecting head according to claim 2, wherein the control circuit includes a logic gate capable of sending, to the switching unit, a signal configured to allow the voltage to be applied to the predetermined protective member, and in a case where the signal configured to allow the voltage to be applied to the predetermined protective member is sent to the logic gate, and further, data with respect to the predetermined protective member, to which the voltage should be applied, is sent to the logic gate, the switching unit switches the supply of the voltage so that the voltage is applied to the predetermined protective member.

4. The liquid ejecting head according to claim 3, wherein the control circuit includes:

a shift register configured to store the data with respect to the predetermined protective member, to which the voltage should be applied, in a manner corresponding to the plurality of heat generating resistor elements; and a latch circuit configured to latch the data with respect to the predetermined protective member, to which the voltage should be applied, the data being output from the shift register.

5. The liquid ejecting head according to claim 4, further comprising a drive control circuit configured to supply a current to a predetermined heat generating resistor element out of the plurality of heat generating resistor elements so as to allow the heat generating resistor element to eject the liquid, thus controlling the drive of each of the heat generating resistor elements, wherein in a case where the drive control circuit controls the drive of each of the heat generating resistor elements, the shift register stores therein the data with respect to the predetermined heat generating resistor element, in which the current should flow, in a manner corresponding to the plurality of heat generating resistor elements, and further, the latch circuit latches the data with respect to the predetermined heat generating resistor element, in which the current should flow, the data being output from the shift register.

6. The liquid ejecting head according to claim 1, wherein the protective members are made of iridium or ruthenium.

7. A substrate for liquid ejecting head comprising:

a plurality of heat generating resistor elements that can generate heat;

a plurality of protective members that are located at positions corresponding to the heat generating resistor elements, to protect the heat generating resistor elements, and further, can be eluted into the liquid with the application of a voltage; and a protective member eluting unit that can select a predetermined protective member out of the plurality of protective members and can apply a voltage to the predetermined protective member.

8. A printing apparatus comprising:

a liquid ejecting head including:

a plurality of pressure chambers that can store liquid therein;

heat generating resistor elements that are arranged in a manner corresponding to each of the pressure chambers, and can heat the liquid stored in the pressure chambers;

a plurality of ejection ports, through which the liquid is ejected by heat generated by the drive of the heat generating resistor elements; and a plurality of protective members that are located at positions corresponding to the heat generating resistor elements to protect the heat generating resistor elements, and further, can be eluted into the liquid with the application of a voltage in a state in which the liquid is stored in the pressure chambers;

a voltage applying unit configured to apply a voltage to the protective members; and a protective member eluting unit that can select a predetermined one out of the plurality of protective members and can apply a voltage to the predetermined protective member.

* * * * *